US005725363A

United States Patent [19]

Büstgens et al.

[11] Patent Number: 5,725,363

[45] Date of Patent: Mar. 10, 1998

[54] MICROMEMBRANE PUMP

[75] Inventors: Burkhard Büstgens, Karlsruhe; Gerhard Stern, Pfinztal; Wolfgang Keller, Hambrücken; Dieter Seidel, Eggenstein-Leopoldshafen; Dieter Maas, Oftersheim, all of Germany

[73] Assignee: Forschungszentrum Karlsruhe GmbH, Karlsruhe, Germany

[21] Appl. No.: 669,106

[22] Filed: Jun. 24, 1996

Related U.S. Application Data

[63] Continuation-in-part of PCT/EP94/03954, Nov. 29, 1994.

[30] Foreign Application Priority Data

Jan. 25, 1994 [DE] Germany ..... 44 02 119.4

[51] Int. Cl.[6] ..... F04B 17/00

[52] U.S. Cl. ..... 417/413.1; 417/412; 417/207; 437/212; 437/216

[58] Field of Search ..... 417/207, 412, 417/413.1, 413.2, 413.3, 561, 566; 437/372, 216

[56] References Cited

U.S. PATENT DOCUMENTS

| | | | |
|---|---|---|---|
| 3,606,592 | 9/1971 | Madurski et al. . | |
| 4,646,781 | 3/1987 | McIntyre et al. | 417/566 |
| 5,085,562 | 2/1992 | Van Lintel | 417/412 |
| 5,375,979 | 12/1994 | Trah | 417/207 |

FOREIGN PATENT DOCUMENTS

| | | | |
|---|---|---|---|
| 176166 | 7/1990 | Japan | 417/207 |
| 173755 | 10/1993 | Norway . | |
| 8003289 | 7/1985 | Sweden . | |
| 2088965 | 6/1982 | United Kingdom . | |

*Primary Examiner*—Charles G. Freay
*Attorney, Agent, or Firm*—Klaus J. Bach

[57] ABSTRACT

In a micromembrane pump with pump housing top and bottom parts and a membrane structure disposed between the housing top and bottom parts such that pump chambers, valves, flow channels and a cavity system are formed between the membrane structure and the housing parts, heating means are disposed on the membrane structure in the area of the pump housing for operating said pump and the cavity system is filled with a cement for joining the membrane and the housing parts.

7 Claims, 9 Drawing Sheets

MICROMEMBRANE PUMP

This application is a Continuation-In-Part of PCT/EP94/03954 filed on Nov. 29, 1994 and claiming priority of German Patent Application No. P 44 02 119.4, filed Jan. 25, 1994.

BACKGROUND OF THE INVENTION

The invention relates to a micromembrane pump wherein membranes are disposed in a pump housing and, together, form pump chambers, pump membranes and flow channels.

Micromembrane pumps are known in arrangements for example with two differently driven pumps. Such an arrangement is described by H. T. G van Lintel, van de Pol, in "A Piezo-electric Micropump Based on Micromachining of Silicon", Sensors and Actuators, 15 1988, 153–167 and by H. T. G. von Lintel, M. Elvenspock, J. H. J. Flintman, in "A Thermoplastic Pump Based on Microengineering Techniques" Sensors and Actuators, A21–A23, 1990, 198–202. The first pump includes a pump membrane with a piezo ceramic structure cemented thereon, the second pump includes, above the pump membrane, a thermodynamic drive in the form of an air space which expands when heated. Both pumps have integrated inlet and outlet valves.

Another micropump is described in a publication by Roland Zengerle and Axel Richter in "Mikropumpen als Komponenten für Mikrosysteme": Physik in unserer Zeit, 124th annual progress, 1993, No. 2. This pump also includes integrated valves and pump membranes which are deflected by electrostatic forces.

The stationary and movable parts of the micropumps referred to above represent the state of the art and consist essentially of the basic materials silicon and glass. The elastic parts of the pumps described, that is, mainly the pump and valve membranes, are thinned by etching using different etching procedures. The smallest pump membrane diameters are in the range of 20 μm. In these pumps, the thickness of the membranes and the material properties of glass and silicon are responsible for the limits to the pumping performance. If the membrane diameters are relatively large, then the membrane travel can be only relatively small. Consequently, compression ratios as they are necessary for pumping gas cannot be obtained with such pumps. Furthermore, the diameters of the valves must be made relatively large so that the flexing of the valve membranes and the pressure losses can be maintained at relatively low values.

A further pump is described by R. Rapp, W. K. Schomberg, and P. Bley in "Konzeption, Entwicklung und Realisierung einer Mikromembranpumpe in LIGA-Technik", KfK Bericht No. 5251 (1993). This pump is operated by an external pneumatic actuator and is capable of pumping gases. The pump includes a pump membrane of titanium and valves which include polyimide membranes. The pump membrane can be deflected up to the bottom of the pumping chamber and, consequently, has a high compression ratio. However, for the deflection of the membrane, a relatively high pressure is required which cannot be generated by an integral actuator. Furthermore, for manufacture, all pumps must be cemented together singularly which is relatively expensive. The manufacture of such a pump involves a large number of subsequent independent steps.

It is the object of the invention to provide such a pump which is, however, of simple design and which is easy to assemble with few assembly steps.

SUMMARY OF THE INVENTION

In a micromembrane pump with pump housing top and bottom parts and a membrane structure disposed between the housing top and bottom parts such that pump chambers, valves, flow channels and a cavity system are formed between the membrane structure and the housing parts, heating means are disposed on the membrane structure in the area of the pump housing for operating said pump and the cavity system is filled with a cement for joining the membrane and the housing parts.

It is especially advantageous that, with this design, many pumps can be manufactured at the same time and still with few assembly steps and at low expenses. This is true for the manufacture of the components of a pump such as the pump housing, pump membrane and valves as and also for the accurate cementing of many microcomponents in a single step. Furthermore, the pressure losses are minimized by the partlcular design of the membrane in the area of the actuation chamber.

An embodiment of the invention will be described below on the basis of the drawings:

DESCRIPTION OF PREFERRED EMBODIMENTS

Designs of the micropump, designation for the components

Figure 1:
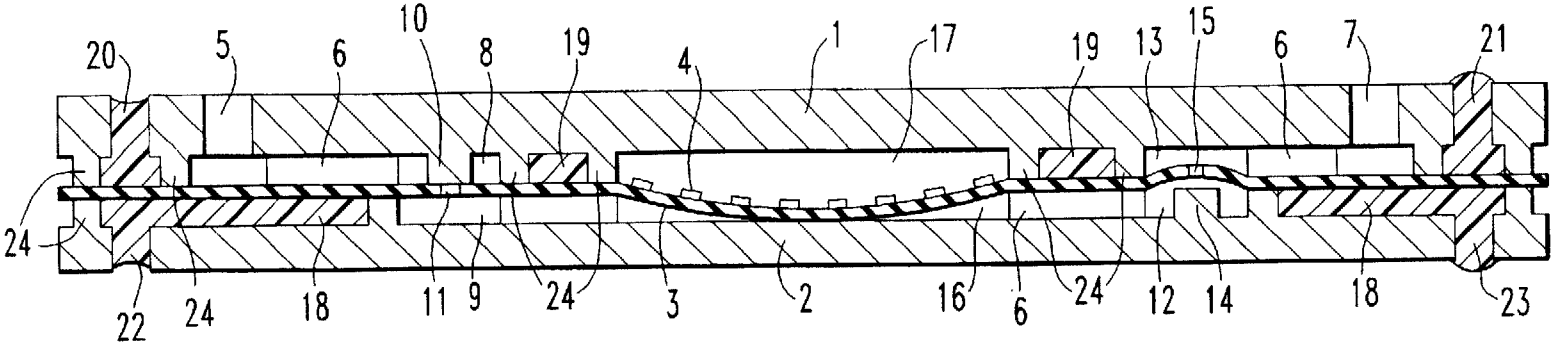
FIG. 1 is a schematic cross-sectional view of a pump.

FIG. 1 shows schematically the basic design of the micropump. As shown in FIG. 1, a polyimide membrane 3 with a thickness of 2 μm is cemented, with its top side to the top part 1 of the pump housing and, with its bottom side to the bottom part 2 of the pump housing. The pump housing contains the removable functional components of the pump. These are the pump housing top part 1, of the actuation chamber 17, various flow channels 6, the valve chamber 8 with the valve seat of the inlet valve 10, the valve chamber for the outlet valve 13, the fluid inlet 5, the fluid outlet 7, a continuous cavity system 19 to be filled with cement and injection openings 20 and discharge openings 21 for filling the continuous cavity system with cement. For the electrical contacts of the pump, there are provided openings which, however, are not shown in the Figures. The functional components disposed in the bottom part of the pump housing are the pump chamber 16, the flow channels 6 between the valves and the pump chamber 16, the valve chamber 9 of the inlet valve 10, the valve seat 14 of the outlet valve 13, cavity system 18 to be filled with cement, a cement inlet 22 and a cement outlet 23. The cavities 18, 19 for the filling procedure and the spaces 6, 8, 9, 12, 13, 16, 17 are separated from one another by webs 24 by which the lateral structures are formed and the height of the structures is exactly defined. The polyimide membrane 3 is characterized by a high elasticity and forms, in the area of the actuation chamber 17, the pump membrane. In the areas of the inlet valve 8, 9, 10 and of the outlet valve 12, 13, 14, there are holes 11 and 15 in the polyimide membrane 3, which provide for valving action as the holes can be closed by the planar valve seals whenever there is excess pressure on the side of the membrane opposite the valve seat. Vice versa, if the pressure on the membrane on the side of the valve seat exceeds the pressure on the opposite side, the membrane is lifted off the valve seat and the hole in the membrane is no longer blocked so that fluid can flow therethrough. The micromembrane pump is actuated by the thermal expansion of a fluid disposed in the actuating chamber 17 when heated by a metallic heating structure 4 disposed on the polyimide membrane.

Operation of the micropump

The heating structure is energized by a short current pulse and is heated thereby. The heat is transferred to the medium in the actuation chamber 17 and to the medium in the pump chamber 16. If gaseous media are present in the actuation chamber 17 and in the pump chamber 16, the pressure increase of the actuation chamber gas resulting from the temperature increase deflects the pump membrane. The deflection of the pump membrane 3 decreases the volume of the pump chamber 16 and leads, together with the concurrent temperature increase of the pump gases, to a pressure increase in the pump chamber 16. If a liquid is used in the actuation chamber 17 which has a low boiling point such liquid will evaporate and, as a result of the vapor generation, generate a relatively high actuation chamber pressure. As a result, a large deflection of the pump membrane 3 in the direction toward the pump chamber 16 is obtained. In both cases, the resulting pressure increase of the medium to be pumped is transmitted, via the flow passages, to the valves whereby, in the area of the inlet valves, the membrane abuts the valve seat 10 and closes the valve whereas, in the area of the outlet valve 15 , the membrane is lifted off the valve seat 14 thereby freeing the opening in the valve membrane through which the pump medium is then discharged.

After termination of the current pulse, the medium in the actuation chamber 17 starts to cool down by heat transfer and heat radiation. If the medium in the actuation chamber is a gas, its pressure and, as a result, the volume of the actuation chamber is reduced thereby; if the medium is a liquid, the vapors will condense and the original conditions will be reinstated. As a result, the pump membrane resumes its original position and, because pump medium was pushed out of the pumping chamber, a vacuum is now generated in the pump chamber 16 and at the valves. In accordance with the valve operation described above, then, the outlet valve closes ad the inlet valve opens and pump medium is sucked into the pump chamber. This process is repeated with each pumping cycle.

The process for arranging the heating structure directly on the pump membrane is quite simple; but such an arrangement has other advantages: first, the heat transfer to the pump housing during the heating phase is minimized. Second, if a liquid with a low boiling point is used as the actuating medium, recondensation of the actuating medium by the pumped medium is initiated in the area of the heating structure. As a result, the heating structure is in optimal heat transfer contact with the actuating liquid at the start of the next heating phase.

The valves

Figure 3A:
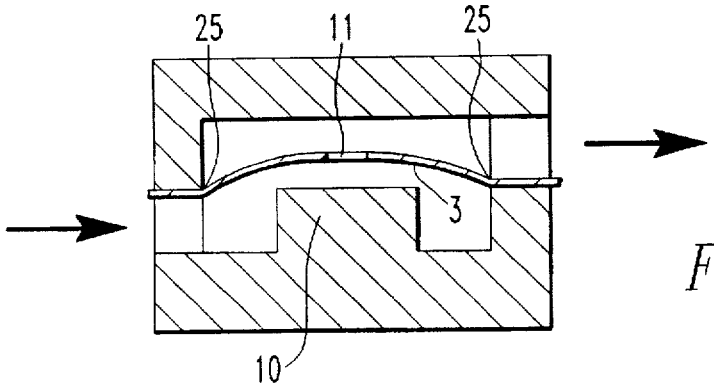
FIGS. 3*a*, 3*b*, 4*a*, 4*b*, 4*c*, 4*d*, 5*a*, 5*b*, and 5*c* show values as they are used in the pump.
Figure 3B:
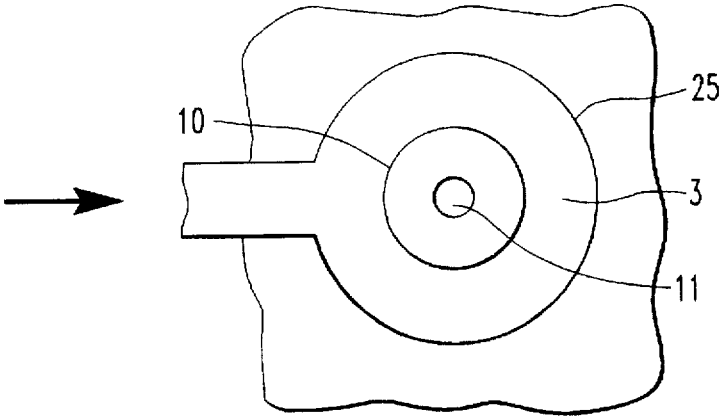
Figure 4A:
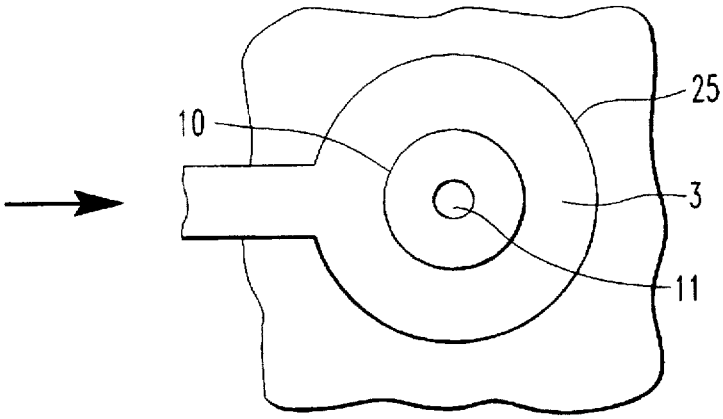
Figure 4B:
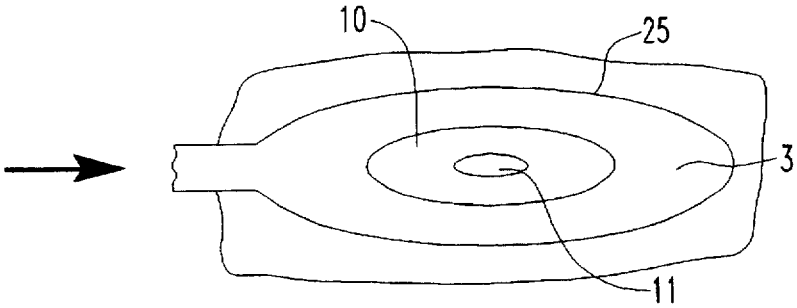
Figure 4C:
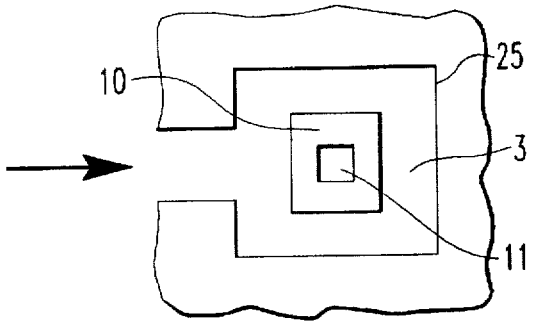
Figure 4D:
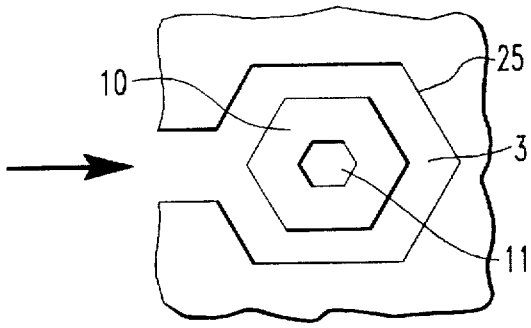

FIGS. 3*a* and 3*b* show one of the valves. The valves comprise a flexible tensioned membrane 3 with central microstructured opening 11. The valve opening 11 may have various shapes. As shown in FIGS. 4*a*, 4*b*, 4*c*, 4*d*, the pump chamber and the corresponding pump membrane portion 25 and also the valve opening 11 may be for example round, oval or in the shape of a polygon. FIG. 3 shows the basic valve design as employed with the pumps. At one side of the membrane, there is a flat, solid valve seat 10 extending around the valve opening and having a width as needed to form a sealing surface between the membrane and the valve seat. The valve seat is formed as a part of one of the two pump housing parts which are connected with the pump membrane. The tightness of the valves in their closing positions depends to a great extent on the amount of coverage, the surface roughness of the valve membrane and the valve seat and very much on the flexibility of the membrane. If the polyimide membrane is very thin, proper sealing may be achieved even under unclean conditions since the membranes would then be in a position to bend around small dirt particles.

Figure 5A:
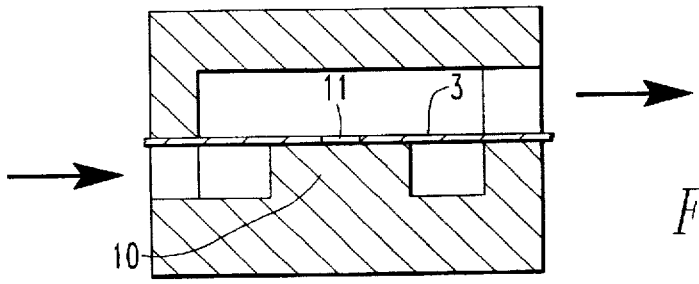
Figure 5B:
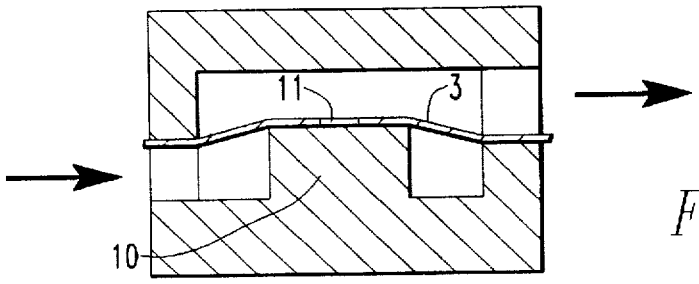
Figure 5C:
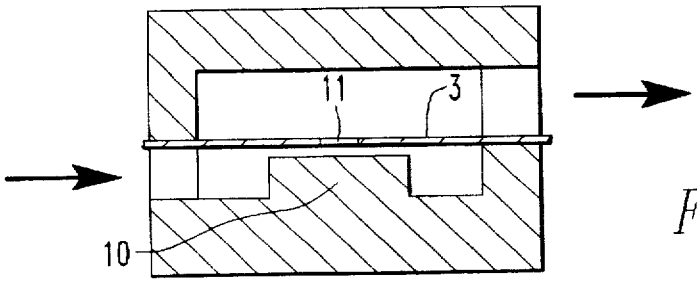

The opening and closing behavior of the valves can be influenced by the height of the valve seat as indicated in FIGS. 5*a*, 5*b*, and 5*c*. FIG. 5*a* shows the arrangement for a normal valve wherein the membrane mounting surfaces and the valve seat are arranged in the same plane. FIG. 5*b* shows an embodiment wherein the valve seat is raised so that the membrane is deflected upwardly in its rest position. Since the membrane is tensioned with this arrangement, a substantial pressure difference is required to open such a valve. Until the pressure difference value has been reached, the valve remains closed in flow direction. With this arrangement, the losses of pressure and efficiency are greater than with the arrangement of FIG. 5*a*. However, the arrangement provides for only small back flow upon changeover of the operating cycle since, with the membrane 3 under tension, the valve closes immediately when the pressure difference across the membrane becomes sufficiently small. This configuration is advantageous for small volume flows with relatively large pressure differences—or, if the operating cycle frequency is relatively high. In the arrangement of FIG. 5*c*, the valve seat does not reach the level of the membrane mounting plane so that the membrane in its rest position is freely stretched. In this case where the membrane is not firmly seated on the valve seat, the valve offers relatively little flow resistance for pumping, but it closes only after a certain closing pressure has been reached. Such an arrangement of valve seat and membrane is advantageous with large volume flows and small pressure differences.

Cementing

If the components of the upper pump housing, the membrane and the lower pump housing are cemented in the conventional manner that is if the cement is applied to the components by techniques such as dispensing, screen printing or Tampon printing, a cement layer is provided whose thickness of about 10 μm is comparable to the size of the microstructures. Then high tolerances in cement gap thickness are unavoidable which has a particularly negative effect on the functioning of the microvalves since the desired distance between the valve membrane and the valve seat cannot be accurately established. Another disadvantage of such cementing techniques resides in the lateral distribution of the cement on the microstructures since various areas such as the valve seat and the passage structures should remain free of cement. Furthermore, after application of the cement, the accurate positioning of the components to be cemented together and the subsequent combination of the components without cement smearing is very difficult. The procedure also requires two steps wherein components have to be held in predetermined positions.

If the components of the pump are held together in proper positions and then cement is injected through the cement inlets all the disadvantages referred to above are circumvented and the components can be cemented together with little effort and in an accurate manner. The design of the microstructure components is already such that the cementing is facilitated. Basically, a substrate which may contain a large number of microstructures includes cavity areas around the microstructures which may be fully or partially continuous and are separated from the functional areas of the microstructures by webs of constant height. The cavity areas have the purpose to take up the cement during the cementing step so that, after cementing, the cement is disposed, separated by the webs, in the cavity areas around the microstructures.

The cement has the purpose of mechanically interconnecting the components to be combined and of sealing particular microstructures and the components with respect to one another. Also, by inner relaxation processes, it reduces internal stresses as they may occur for example as a result of temperature changes between the cemented components. The webs have the purpose to provide, by their height, for an accurately reproducible reference height for setting the cementing gap thickness and to prevent the cement from flowing into the microstructures during the cementing procedure.

Figure 6:
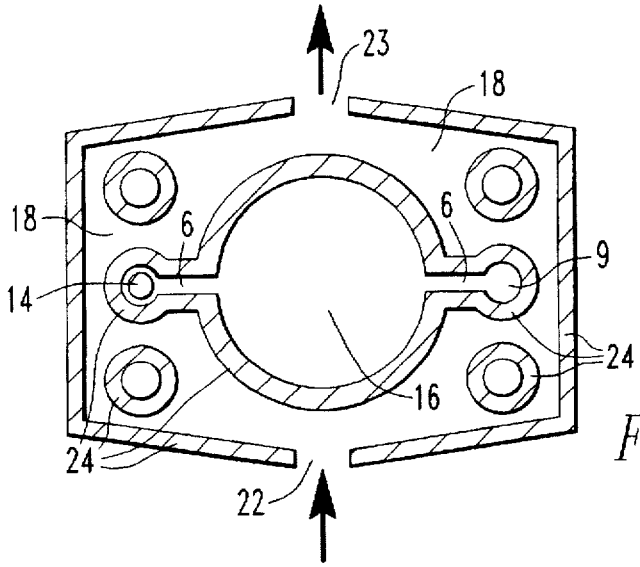
FIGS. 6, 7*a*, 7*b*, 7*c*, 7*d*, 7*e*, 7*f*, 9, 10, 11, 12*a* and 12*b* illustrate the cementing technique.

FIG. 6 is a view of the housing bottom part of the micropumps which illustrates the conditions during manufacture. The numeral 18 indicates the concave structure that is the cavity system which receives the cement, the numeral 24 indicates the web structures which limit the cement area and the numerals 16, 9, 6, 14 designate the operational areas of pump chamber, valve chamber, flow channels of the pump and valve seats which must remain free of cement. The numeral 22 indicates the opening through which cement is introduced and the numeral 23 indicates the outlet opening through which excess cement can exit or flow into another microstructure.

Figures 7A, 7B, 7C:
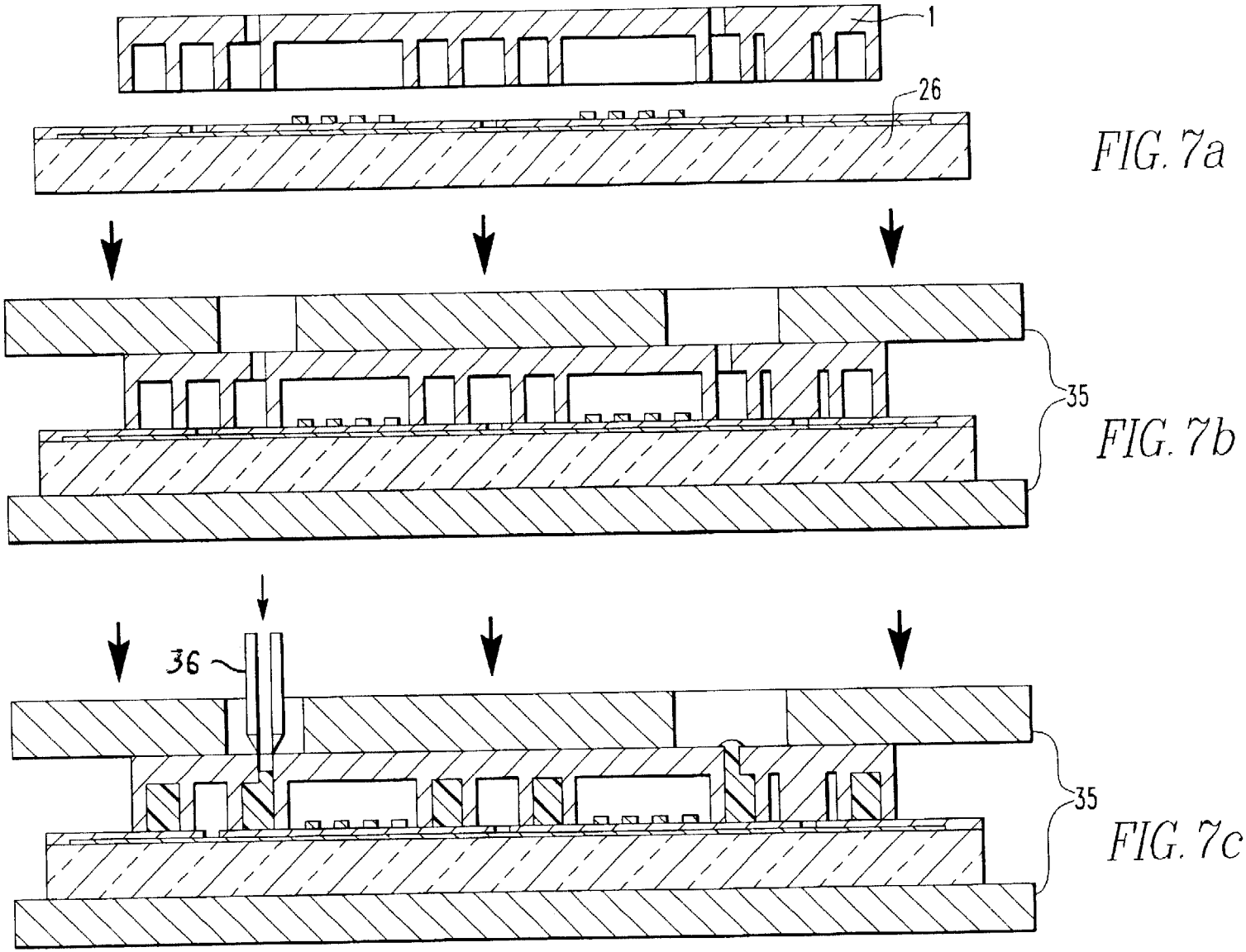
Figure 7D:
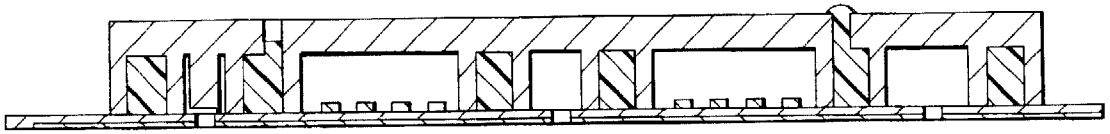
Figure 7E:
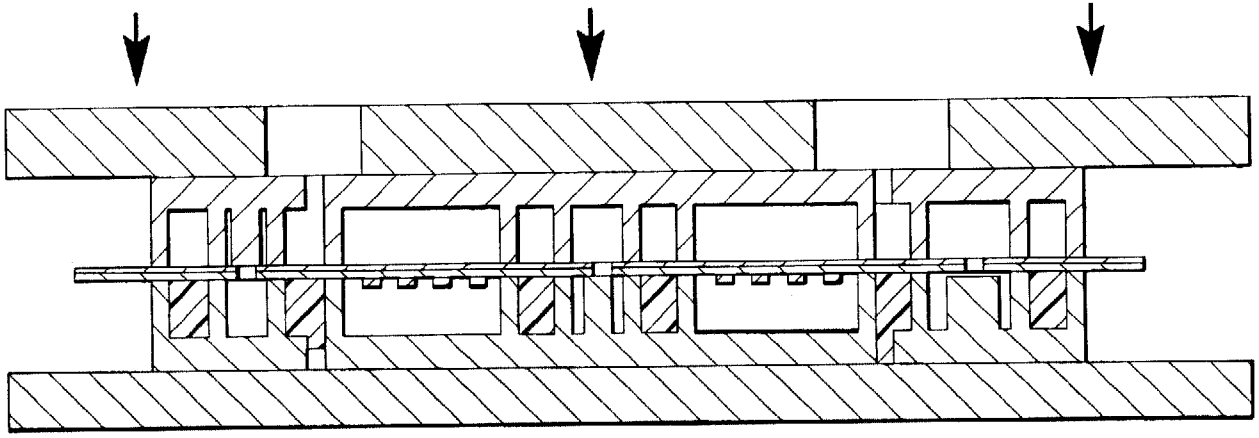
Figure 7F:
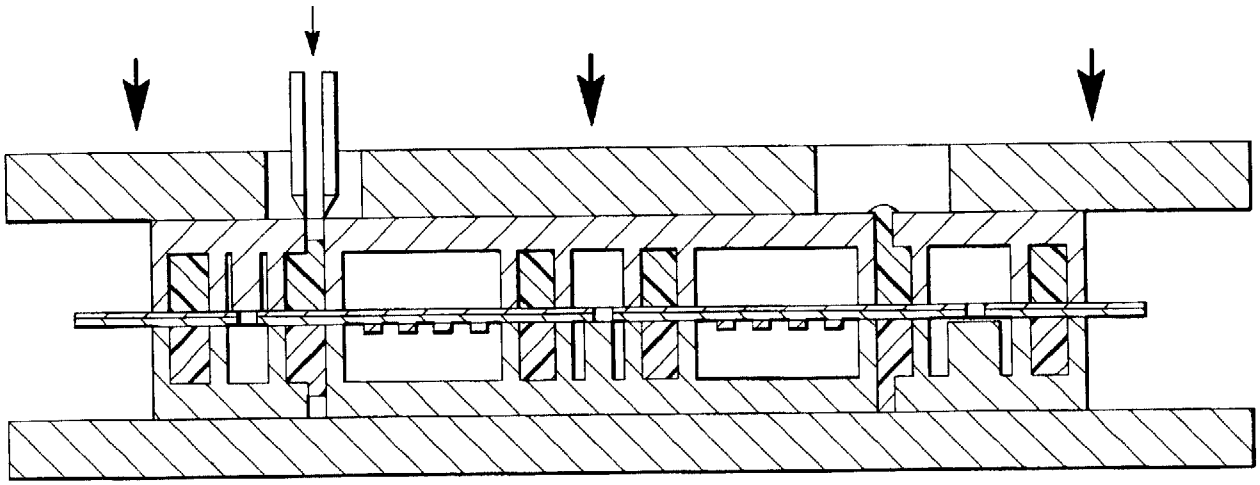
Figure 9:
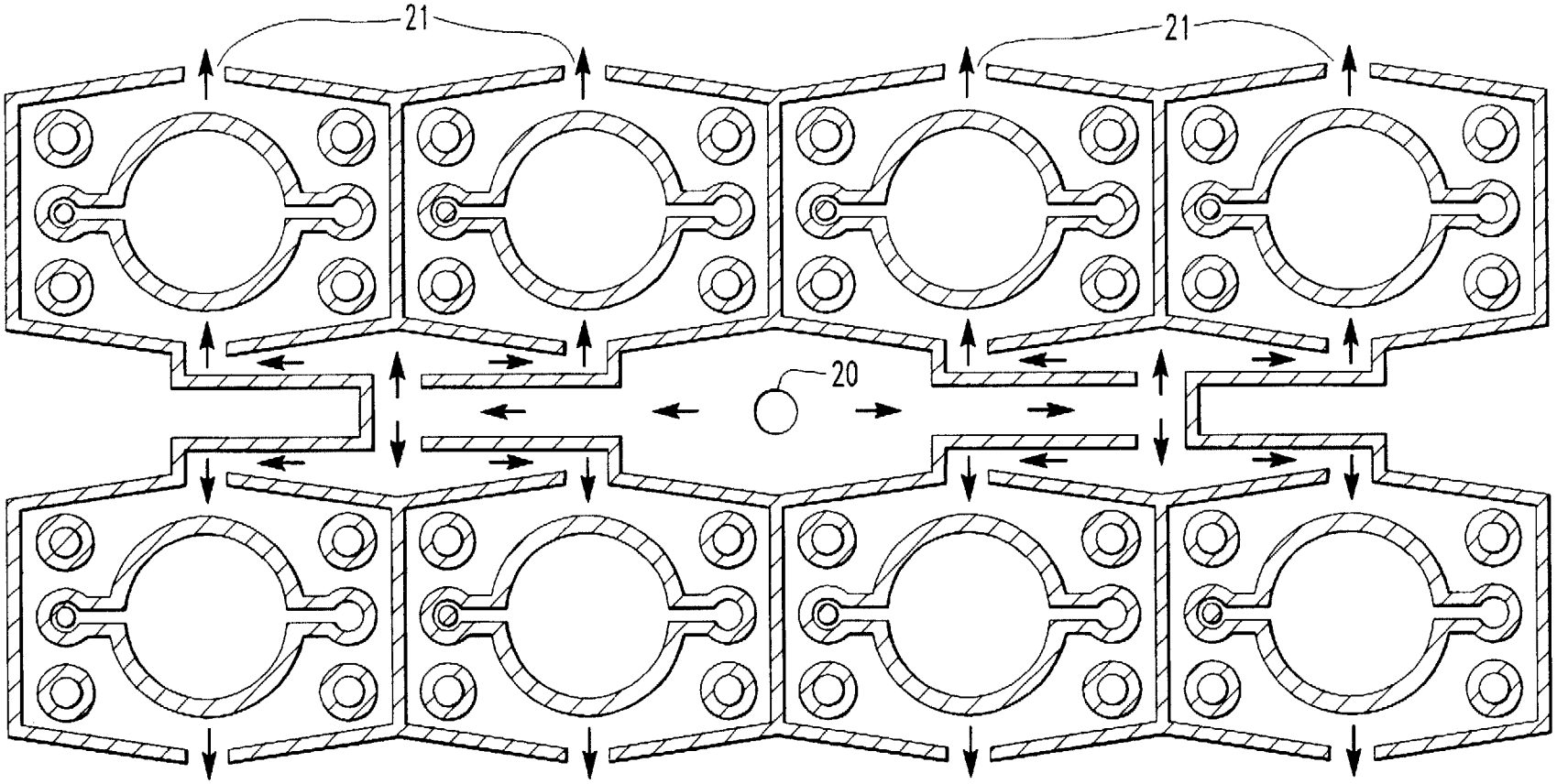
Figure 10:
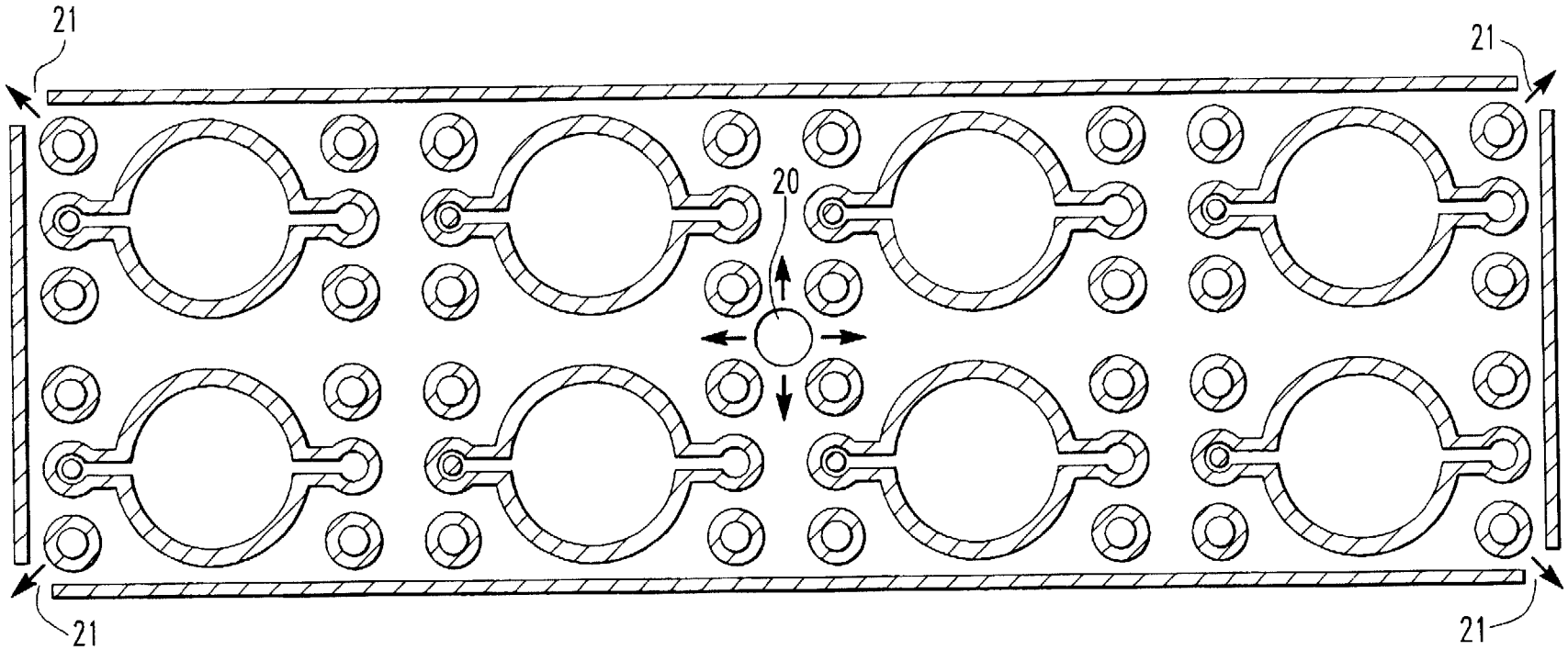
Figure 12A:
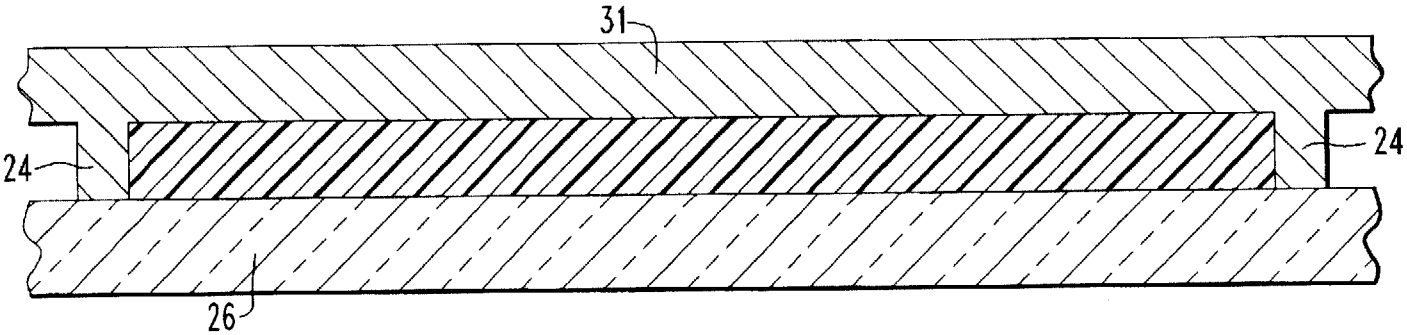
Figure 12B:
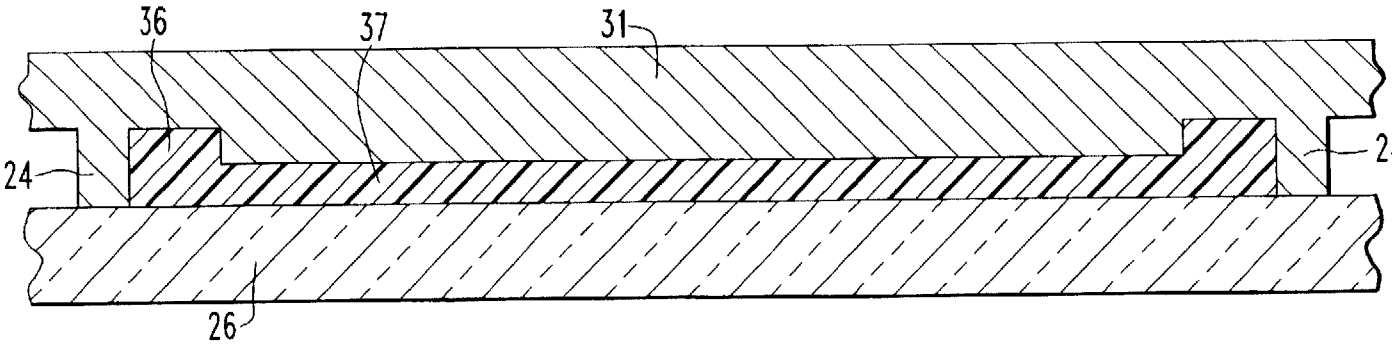

FIGS. 12*a* and 12*b* are cross-sectional views showing the concave structures for the reception of the cement between two microstructure components. The numeral 24 indicates the webs which separate the cement area from the microstructure; 26 and 31 indicate the local areas being cemented together. FIG. 12*a* shows an arrangement wherein the cement layer thickness corresponds in thickness to the height of the webs (=reference height). FIG. 12*b* shows an arrangement wherein the concave structure includes areas 36 of increased height particularly for the supply of the cement and areas of lower height which provide for a reasonable space for the particular cement used. The cementing procedure begins with the proper positioning of the components to be cemented relative to one another (FIG. 7*a*) and the subsequent fixing of the components by way of a clamping means 35 (FIG. 7*b*). The clamping means insure that the webs 23 of the one part to be joined are pressed onto the other whereby a close contact is safely established. Such close contact provides for an accurate setting of the desired distances between the structures of the two parts to be joined and provides for sufficient sealing during the cementing procedure. Position adjustment of the two parts and clamping occurs without the presence of any cement which has the advantage that any problems associated with the handling of the cement do not have any detrimental effects on the precision of the cementing. During the cementing procedure (FIG. 7c) cement is introduced into the cavity structure formed by the joining of the parts. In this step, either microstructures with cement injection openings 22 and discharge openings 23 (see FIG. 6) can be singly filled or a large number of microstructures with appropriately prepared cavities can be filled by way of a channel system (see FIG. 9) or the microstructures can be filled by way of a complete cavity system (see FIG. 10). The filling procedure depends on the fluid dynamic properties of the cement to be used. For controlling the filling procedure, the cement may be injected by way of a nozzle which is placed tightly onto the cement injection opening 20. Depending on the viscosity and on the wetting capability of the cement and also on the desired injection speed the cement is injected into the microstructures with an excess pressure until it exits from the discharge opening 21. Cement flow and distribution are dependent on the geometry of the cavity system and the pressure applied. Further control of the flow process can be achieved by applying a vacuum to the discharge openings 21. This may become necessary if, during the design of complex passage systems, the fluid-dynamic conditions for a uniform filling could not sufficiently be taken into consideration. After filling, the cement is cured in accordance with its specific properties.

Suitable for this procedure are all cements which have sufficient adhesive qualities and which can, under reasonable pressures, flow into the micropassages and microcavities. The surface tension of the cement and the resulting capillary properties are especially important for the joining of the parts. Cements with high wetting capabilities can enter the smallest gaps. This may lead to a cement when being injected into the parts to be joined to flow under the webs because of surface roughnesses in nanometer range and this may well be undesirable for proper functioning of a microcomponent. Generally, however, this effect does not lead to malfunctioning of the microcomponent if the cement does not flow beyond the edges of the webs which are remote from the cement cavities and wets the microstructures which should remain free of cement. If the flow of the cement under the webs should be completely prevented, the cementing process could be expanded by an intermediate step which provides for a complete seal under the webs. For this purpose, the microstructures which include the webs are contacted, in a stamping procedure, with a highly viscous, chemically stable layer which may be formed by application to a flat substrate with even thickness. This may be an industrial grease which can be washed out by a solvent without residue after cementing. If the webs are then pressed onto the parts to be cemented together (see FIG. 7) the layer applied which has a thickness corresponding to the surface roughness will fully seal the cement cavities with respect to the cement free functional areas. The cement can no longer pass through the small gaps by capillary action.

It is further possible to use meltable cements if their operating temperature does not destroy or detrimentally affect the parts to be joined. In this case, the parts to be joined need to be heated to the operating temperature of the cement before the filling procedure can begin.

Figure 11:
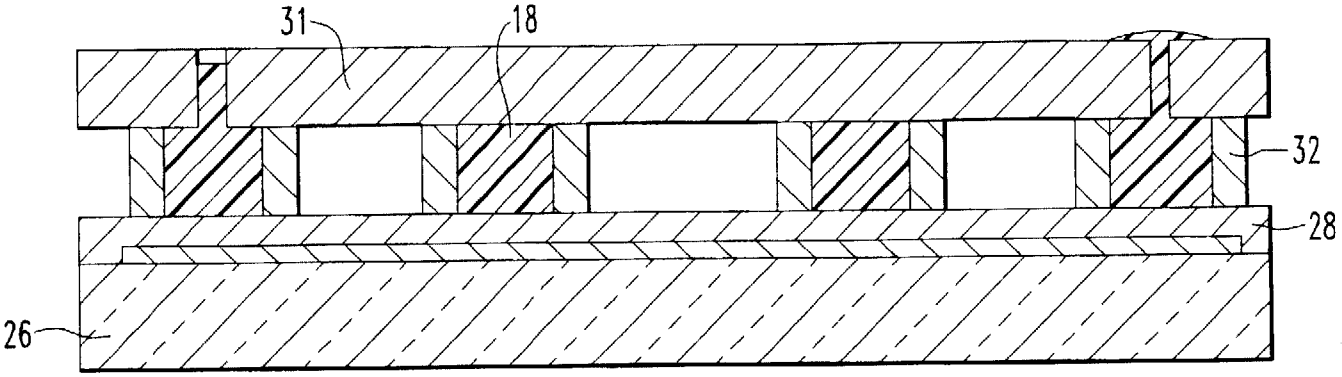

It is also possible that more than two parts participate in one cementing procedure. This will then be the case, if as shown in an example in FIG. 11, an auxiliary structure 32 is used to cement a first structure 28, 26 together with a second structure 31. The auxiliary structure 32 provides for a separation of the areas which should contain cement from the areas which must remain free of cement. It also provides for the accurate desired distance between the parts to be cemented. The auxiliary structure may be individually placed in position or it may be mounted onto one of the parts to be joined.

Below the manufacture of the individual components of the micropump is described on the basis of an example:

Each of the three individual components, that is pump housing top part 1, pump membrane 3 with metal structure 4 disposed thereon and pump housing lower part 2 as shown in FIG. 1 were manufactured independently. Consequently, the individual components can be tested before their assembly.

Housing, mold insert, procedure

Figure 2:
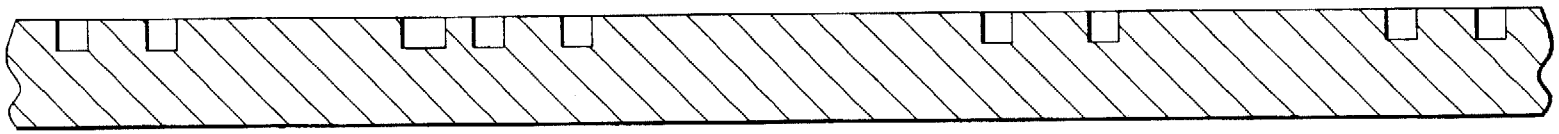
FIG. 2 shows a die for the manufacture of th pump.

The upper pump housing part 1 and the lower pump housing part 2 were manufactured by means of a microstructured molding tool by methods common in injection molding and vacuum molding processes. FIG. 2 illustrates in an exemplary manner the structure of a molding tool for making the housing top part shown in FIG. 1. A semi-finished product of brass with a ground and polished molding surface which was prepared for use in a plastic material molding apparatus was structured by means of a microcutter (diameter: 300 μm). It includes the structures for the valve seals and also the structures for the separation of the cement areas from the functional areas of the micropump. The mold inserts could be provided with grooves of simple geometry simply by cutting which required little machine cutting time. A first molding tool included the structures for twelve top pump housing parts 1, and a second molding tool included the structures for twelve bottom pump housing parts.

For the manufacture of the plastic pump housing parts, parameters of the vacuum molding arrangement as well as parameters of the injection molding arrangements were selected in such a way that the total thickness of the molded parts was 1 mm. As materials, the plastic material polyvinyldifluoride (PVDF) (in the vacuum molding machine) were used. The materials mentioned have a high chemical stability, they are optically transparent and temperature resistant. A property of all plastic materials which is undesirable in comparison to metals as far as their use for pmnps is concerned, is that they have a relatively low heat transfer coefficient. Consequently, with the use of plastic materials for the pump housings, heat removal is relatively small when compared with pump housings of metal with the same thickness walls. As a result, the pump can be operated only at relatively low performance in order to avoid overheating. This disadvantage can be circumvented by providing a pump housing of relatively little overall thickness and by providing intense heat exchange contact with a base substrate of high heat conductivity. A cooled body may be used as a substrate. A small thickness can be obtained by appropriate selection of the molding parameters and by machining by means of an ultra cutter or by a plasma etching process. The openings for the fluid inlet and outlet (5, 7 in FIG. 1) for the injection of cement and for the displacement of air (openings 20, 21, 22, 23 in FIG. 1) and also the openings for the electrical penetrations have not been considered in the mold insert but they were drilled subsequently by special drills providing bores with 0.45 mm and 0.65 mm diameter.

Manufacturing procedure

Figure 8A:
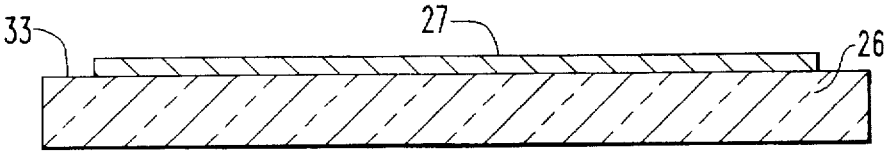
FIGS. 8*a*, 8*b*, 8*c*, 8*d*, 8*e* illustrate the manufacture of a membrane with heating means.
Figure 8B:
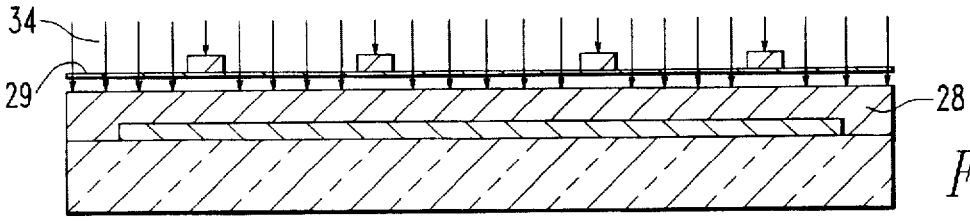
Figure 8C:
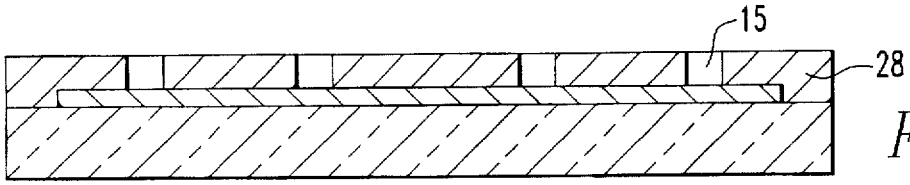
Figure 8D:
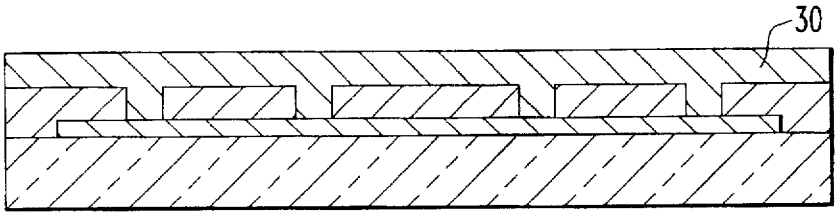
Figure 8E:
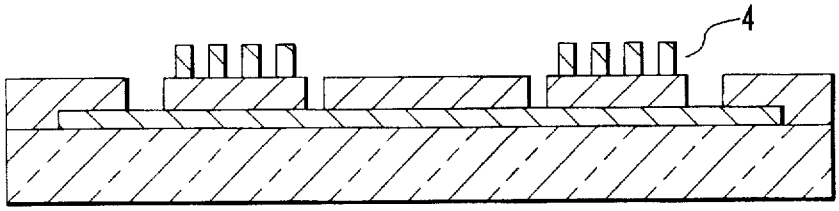

The core piece of the micropump is a polyimide foil with a heating coil directly disposed thereon. The polyimide foil which is lithographically structured with a single mask for a large number of individual pumps is used as membrane for the pump and also for the valves. An electrically conductive layer was deposited on the membrane by thin-film techniques and the electrically conductive layer was then structured to form heating coils in the areas of the individual pump membranes. The contact surface areas for the electrical connection of the heating coils were arranged in each case outside the pump membrane area. The manufacturing process for the structured polyimide foil and of the heating coil structure will be explained better on the basis of the manufactured pumps (FIG. 8*a*–8*e*). As carrier substrate for the thin-film process, a silicon wafer with a diameter of 100 mm was used. Since the foil must be separated from the wafer after the first cementing, a thin separation layer 27 of gold was sputtered onto the wafer (FIG. 8*a*). A marginal area 33 of 5 mm at the circumference of the wafer was covered during the sputtering step in order to maintain adherence of the polyimide foil to the silicon substrate so as to prevent premature peeling of the polyimide foil from the wafer. Then (FIG. 8*b*), a polyimide layer 28 of the photostructurable poiyimide Probimide 408 by CIBA-GEIGY was applied by means of a lacquer centrifugal applicator to a thickness of 3 μm which was then dried in a heating step. The dried layer was then subjected to UV light 34 in a contact procedure. Since the used polyimide is a negative layer, the chromium mask 29 used during light exposure provided for light exposure of those areas in which the polyimide foil was to remain and for coverage of those areas which were to be dissolved during development. The last areas are the holes for the valves 15 and the various adjustment marks. Then the polyimides were developed followed by baking in a vacuum oven (FIG. 8*c*).

After the polyimide was structured, a titanium layer 30 with a thickness of 2 μm was applied by magnetton sputtering in order to form therefrom the heating coil structure which adheres firmly to the polyimide. The titanium layer 30 was structured by a positive lacquer (AZ4210) and a subsequent etching process in a hydrofluoric acid containing solution. The light exposure of the photolacquer used was adjusted on the basis of control marks in the polyimide layer and on the basis of control marks on the mask for the structuring of the titanium layer. FIG. 8 shows the finished membrane structure on the auxiliary substrate.

During the manufacture of the titanium layer, the sputtering parameters (temperature, bias voltage, gas flow and the electric power generating the plasma) were so adjusted that an internal tensile stress developed in the titanium. The heating structure on the membrane was therefore also under tensile stress. After the removal of the combination of heating structure 4 and polyimide membrane 3 from the silicone wafer 26, the titanium which has a much higher modulus of elasticity than the polyimide, contracted together with the polyimide foil. The polyimide foil was compressed in the process. Because of the shape of the heating structure on the foil the pump membrane was not only tension-free, but it was slack. For the deflection of such a slack pump membrane, almost no energy is needed. If the heating structure is in the form of a double spiral, the tension reduction of the heating structure after removal of the substrate results in a reduction of its length what, by the laws of geometry, has the result that the inner areas of the polyimide membrane experience a radial translation toward the center which is large in relation to the elastic material expansion. This translation leads to a curvature in the membrane. A curvature in a membrane can also be obtained by providing other tangentially oriented structures around the membrane or in the membrane. The structure can be formed by closed or interrupted circles, by closed or open polygon-type lines or by spirally arranged closed or interrupted polygon-like line structures.

The arranging of the heating structure on the membrane has two important advantages. First, the heat transfer to the pump housing during the heating phase is minimized. Second, if a liquid with low boiling point is used as the actuating medium, recondensation of the actuating medium is initiated by the pumped medium in the area of the heating structure. As a result, at the beginning of the next heating phase, the heating structure is in optimal heat transfer contact with the actuating liquid.

Instead of polyimide, other plastics or even metals may be used as membrane material. However, metal membranes would require an insulating layer between the membrane and the heating structure.

Assembly of the micropumps

The micropump components manufactured in this manner, that is the pump housing top part, the pump housing bottom part and the polyimide membrane with the titanium heating coil, were checked for faults and were then ready to be cemented together. The three separate components were joined by two cementing steps (FIG. 7) of the type described. For this purpose, a simple clamping tool 35 was provided into which the parts to be joined were placed in proper positions relative to one another and then clamped together. In the first cementing step, the polyimide foil which was disposed on the silicon substrate 26 was cemented to the top housing part 1 which, among others, comprises the actuation chamber and all the pump connections (FIG. *7a–7c*). In order to obtain a further reduction of tensions in the free membrane areas of the micropumps, position adjustment, clamping and filling with cement was done at a temperature of about 100° C. Since the pump housings of PSU or PVDF have a much higher temperature expansion coefficient than the silicon substrate, the lateral dimensions of the components to be joined were so selected that the components fit perfectly only after having been heated to 100° C. At room temperature, the structural dimensions of the membrane and of the heating structure on the substrate 26 are somewhat greater than the corresponding dimensions of the pump housing. When the parts after being cemented together cool down to room temperature, the contraction of the plastic housing results in the membrane becoming somewhat slack.

After complete hardening of the cement at 150° C., the wafer together with the attached pump housing top part 1 was removed from the clamping means 35 and the polyimide foil was cut around the rectangular plastic part. With the progressing cooling, the polyimide foil came loose from the silicon wafer starting at the cut marginal area aided by the contraction of the plastic housing part 1 (FIG. *7d*).

In the second cementing step, the pump housing bottom part 2 was cemented onto the membrane and the housing top part 1 (FIG. *7e–7f*). For placing the pump into operation, the necessary electrical and fluid connection were made and the individual pumps were separated.

The pumps were operated with a power supply of 15 Volts and a frequency of 3 Hz. The voltage was applied each time for 58 ms. The power supplied on the average was 0.27 W. The pumping rate for air was measured to be 26 ml/min. The deflection of the pump chamber 16 could be observed with the naked eye and the opening and closing of the valve membranes could be observed through a microscope.

What is claimed is:

1. A micromembrane pump comprising a pump housing top part, a pump housing bottom part and a membrane structure disposed between the housing top and bottom parts, one of said housing top and bottom pans forming with said membrane structure a pump chamber, said membrane structure further defining with said housing parts flow channels in communication with said pump chamber, said housing parts including valve structures forming with said membrane structure valves for pumping a fluid, said membrane structure further forming in the areas of said pump chamber a pump membrane and, in the area of said valves, assuming valving functions for controlling the flow of fluid through said pump, heating means disposed on said membrane structure adjacent said pump chamber and a cavity system formed in at least one of said housing parts adjacent said membrane, said cavity system being filled with cement for joining said membrane with said housing parts.

2. A pump according to claim 1, wherein said heating means is an electrically heatable heating element.

3. A pump according to claim 1, wherein said membrane structure consists of a single membrane extending across said pump chamber and said valves.

4. A pump according to claim 1, wherein said valves comprise valve seats formed from said housing parts and membrane areas with holes disposed adjacent said valve seats.

5. A pump according to claim 1, wherein an actuating chamber is disposed in the other of said housing parts adjacent said pump chamber.

6. A method of manufacturing a micromembrane pump comprising a pump housing top part, a pump housing bottom part, a membrane structure disposed between the housing top and bottom parts, said membrane structure defining with one of said housing parts a pump chamber, said housing parts including valve structures forming with said membrane structure valves and flow channels for pumping a fluid, said membrane structure forming in the areas of said pump chamber a pump membrane which, in the area of said valves, assumes valving functions for controlling the flow of fluid through said pump, and heating means disposed on said membrane structure adjacent said pump chamber and a cavity system formed in said housing parts adjacent said membrane, said method comprising the steps of:

a) positioning the membrane structure on said one pump housing part, b) clamping said membrane and said one housing part together such that the cavity system is sealed between said one housing part and said membrane, c) filling said cavity system with a cement, and d) curing said cement for attachment of said membrane to said one housing part.

7. A method according to claim 6, wherein several pumps are made concurrently.

* * * * *